US005757129A

United States Patent [19]

Schafnitzel et al.

[11] Patent Number: 5,757,129

[45] Date of Patent: May 26, 1998

[54] LOW-PRESSURE MERCURY-VAPOR DISCHARGE LAMP, AND METHOD OF PLACING MERCURY THEREIN

[75] Inventors: Hubert Schafnitzel, Koenigsbrunn; Friedrich Lauter, Augsburg, both of Germany; John W. Shaffer, Danvers, Mass.

[73] Assignee: Patent-Treuhand-Gesellschaft Fuer Elektrische Gluehlampen mbH, Munich, Germany

[21] Appl. No.: 611,822

[22] Filed: Mar. 6, 1996

[30] Foreign Application Priority Data

Mar. 31, 1995 [DE] Germany ..... 195 12 129.5

[51] Int. Cl.[6] ..... H01J 61/24; H01J 9/00

[52] U.S. Cl. ..... 313/565; 313/490; 445/9

[58] Field of Search ..... 313/565, 547, 313/490, 550; 445/9, 10, 21, 22, 38

[56] References Cited

U.S. PATENT DOCUMENTS

| | | | |
|---|---|---|---|
| 4,093,889 | 6/1978 | Bloem et al. | 313/490 X |
| 4,622,495 | 11/1986 | Smeelen | 315/248 |
| 4,636,686 | 1/1987 | Vrieze | 313/565 |
| 4,808,136 | 2/1989 | Schuster | 445/9 |
| 4,907,998 | 3/1990 | Kuijer et al. | 445/9 |
| 4,972,118 | 11/1990 | Yorifuji et al. | 313/565 |
| 5,055,738 | 10/1991 | Yorifuji et al. | 313/490 |
| 5,204,584 | 4/1993 | Ikeda et al. | 313/565 |
| 5,294,867 | 3/1994 | Grossman | 313/490 |

FOREIGN PATENT DOCUMENTS

| | | |
|---|---|---|
| 0 265 266 | 4/1988 | European Pat. Off. . |
| 0 646 941 | 4/1995 | European Pat. Off. . |
| 70 661 | 1/1970 | Germany . |
| 35 10 156 | 10/1985 | Germany . |
| 92 10 171 | 11/1992 | Germany . |

OTHER PUBLICATIONS

Patent Abstracts of Japan, JP 60-218757, "Low Pressure Mercury-Vapor Electric-Discharge Lamp", Mar. 18, 1986, vol. 10, No. 69 (E-389).

Patent Abstracts of Japan, JP 62 287546, "Manufacture of Bent Tube Fluorescent Lamp", May 28, 1988, vol. 12, No. 184 (E614).

Patent Abstracts of Japan, JP 60 154 451, "Low-Pressure Mercury-Vapor Electric Discharge Lamp", Dec. 17, 1985, vol. 9, No. 321 (E-367).

Patent Abstracts of Japan, JP 62 241 238, "Manufacture of Tubular Bulb", Apr. 8, 1988, vol. 12, No. 111 (E-598).

"Neues aus der Technik" (Technology News), Feb. 1986.

*Primary Examiner*—Ashok Patel

*Attorney, Agent, or Firm*—Frishauf, Holtz, Goodman, Langer & Chick, P.C.

[57] ABSTRACT

A low-pressure mercury-vapor discharge lamp, which is equipped with Hg or amalgam, has a pumping tube opening (4) with constricted cross-section or lumen. A solid body in the pumping tube (3) prevents the mercury from emerging into the discharge space. At the same time, the particular shape of the constriction and of the solid body, respectively, makes it possible for Hg vapor to diffuse through-passages between the pumping tube and the solid body into discharge vessel.

23 Claims, 5 Drawing Sheets

LOW-PRESSURE MERCURY-VAPOR DISCHARGE LAMP, AND METHOD OF PLACING MERCURY THEREIN

Reference to related patents and application assigned to the assignee of the present invention:

U.S. Pat. No. 5,055,738, Yorifuji et al.;
U.S. Pat. No. 4,907,998, Kuijer et al.;
U.S. Pat. No. 4,622,495, Smeelen;
U.S. Pat. No. 4,808,136, Schuster;
U.S. Pat. No. 4,972,118, Yorifuji et al.;
U.S. Pat. No. 4,636,686, Vrieze;
U.S. Pat. No. 4,093,889, Bloem et al.;
U.S. application Ser. No. 08/098,596, filed Jul. 28, 1993, Panofski, abandoned.

Cross reference to related disclosures:

DD-DWP 70 661, Bath;
DE-OS 35 10 156, Verheij;
German 92 10 171U;
"Neues aus der Technik" (Technology News) No. 1/86.

FIELD OF THE INVENTION

The present invention relates to low-pressure mercury-vapor discharge lamps having amalgam or mercury in a discharge space, and to a method of introducing the mercury into the lamp.

BACKGROUND

Fluorescent lamps require mercury, which is introduced into the lamp in either liquid or solid form, in particular as an amalgam. The amalgam lamps can have different designs. For example, they may be conventional fluorescent lamps with a rod-shaped discharge vessel, or compact fluorescent lamps with bent tubes, for example bent in the shape of a U or in the shape of an H, or else spherical electrodeless low-pressure discharge lamps.

Compact fluorescent lamps of this kind are disclosed, for example, in U.S. Pat. No. 5,055,738. The amalgam is, in this case, incorporated in the pumping tube, the discharge-side opening of which is slightly constricted. As an alternative, it is also possible for the pumping tube itself to have a constriction, see, for example, U.S. Pat. No. 4,907,998.

A spherical electrodeless low-pressure discharge lamp is disclosed, for example, in U.S. Pat. No. 4,622,495. The main amalgam is incorporated in a hollowed depression. A variant of this lamp is described in "Neues aus der Technik" (Technology News) No. 1/86, the main amalgam being situated in a closed pumping stem whose upper side has a slightly asymmetric constriction. This is intended to prevent the amalgam from entering the bulb and being capable of damaging the fluorescent layer or other parts, or failure to reach the corresponding working temperature.

A problem, however, is that the amalgam can enter the discharge vessel if the opening, as is the case in the above-described prior art, is relatively wide so that reliable pumping and filling are guaranteed. Furthermore, a former procedure was to constrict the opening of the pumping tube to a capillary, in order reliably to prevent escape of the amalgam (see DD-DWP 70 661). In contemporary modern mass-production lines, pumping and filling would, however, therefore take too long. This is because capillaries of this kind must have a diameter of the order of 0.5 mm.

The present invention makes use of the basic techniques of U.S. patent application Ser. No. 08/098,596, abandoned, but published as German 92 10 171 U and U.S. Pat. No. 4,808,136, to the content of which reference is hereby expressly made. The latter describes a storage element for metering and introducing mercury as liquid metal or liquid or solid amalgam, the storage element being formed by a porous molded part, in particular made of iron. The former describes a solid amalgam body or amalgam-forming body having a ferromagnetic component.

It has now been shown that, with suitable alterations, these basic techniques provide an ideal precondition for reaching a compromise between the two extremes which were mentioned above as the prior art.

In the case of a low-pressure mercury-vapor discharge lamp having, attached to the discharge vessel, a pumping tube whose outer end is sealed by melting and whose inner end, on the discharge side, is open, fast pumping and filling, with reliable retention of the mercury at the same time, are achieved in that the mercury (Hg) is incorporated in the pumping tube in metallic form or as an amalgam (generally referred to below as Hg body).

DEFINITION

Specification and claims use the term "lumen". "Lumen" is used in the dictionary sense as "the bore of a tube, as of a hollow needle or catheter"; that is, the effective clear diameter or path through the tube.

THE INVENTION

The object of the invention is to provide a fluorescent lamp which permits fast and reliable pumping and filling, which is so constructed that no amalgam can escape into the discharge space.

Briefly, the end opening or the lumen of the pumping tube on the discharge side is reduced, or constricted. Together with, and in addition to, the Hg body, a solid body is incorporated in the pumping tube in such a way that it partly closes off the opening of the pumping tube, forming what might be termed a plug or stop for the Hg body. A particularly advantageous arrangement is one in which the solid body has, in every orientation, a cross-section different from the end opening of the pumping tube. In this way, during operation, the effective aperture for diffusion of mercury between the pumping tube and the discharge vessel is kept very yet, the solid body or the Hg body is prevented from entering the discharge vessel. At the same time, the special shape of the constriction allows diffusion of mercury between the pumping tube and the discharge space.

The solid body can preferably be made of ferromagnetic material (in particular iron), so that it can be held fixed at any desired position in the pumping head, by means of a magnet, during the pumping and filling process. As a process technique, this has proved to be even more favorable than the use of a ferromagnetic amalgam (partner) body, but the latter is not, however, excluded.

The solid body may be spherical, ellipsoidal, or of irregular shape; the pumping opening, however, in each case should have a different shape, and especially an asymmetrical shape.

In a preferred embodiment, the solid body at least approximately forms a circular cylinder (for example, rounded off exactly or in the shape of a tablet, or slightly elliptically distorted) with assigned diameter and assigned height. Good results can be achieved if the diameter of the solid body corresponds to between 50 and 90%, in particular 60 and 80%, of the internal diameter of the pumping tube, so that sufficient space is left between the solid body and the wall of the pumping tube. In particular, in this case, the height of the solid body should be smaller than its diameter and, in particular, should correspond to about 50 to 80% of the diameter of the solid body. Experience shows that this dimension is particularly favorable for friction-free operation of the filling process, with regard to randomly varying orientation of the solid body in the pumping tube. Jamming or damage is therefore minimized. The solid body can rotate freely in the pumping tube.

The solid body forms, so to speak, a plug which incompletely closes off the pumping opening. In order to guarantee this, the solid body and the pumping opening must have different shapes. In one embodiment, when the solid body is circular (sphere or circular cylinder), the opening of the pumping tube must not be circular, but should instead define a largest length dimension and transverse dimension, the length dimension being larger than the transverse dimension. Correspondingly, it is, in principle, also conversely possible to combine a non-circular solid body (ellipsoid, cube or parallelepiped) with a circular opening.

The following can serve as an indication for the geometrical dimensions to be chosen in the case of a circular cylindrical solid body: either the largest or transverse direction is larger, in particular larger by 0.1 to 0.4 mm, than the height of the solid body, or the largest length dimension is larger than the diameter of the solid body. Advantageous when satisfying only one of these conditions is that the constriction of the opening extends over a certain height (typically 1 to 2 mm). Because of the different shape of the opening it is nevertheless never possible for the solid body to close off this opening completely, even in this case. In the ideal case, both conditions are satisfied at the same time.

Particularly advantageously, the largest transverse dimension of the opening is smaller than the diameter of the solid body.

When the solid body is circular, the opening can preferably have a cross-section which is elliptical or similar to a half-moon. It may also be shaped similarly to an "8" or in the shape of a crescent. It may have any asymmetrical shape. In this case, it is, in principle, of no importance whether the opening is attached to the pumping tube centrally or off-center, but an off-center opening located as closely to the wall of the tube as possible is more favorable because it allows more possibilities for the shape of the opening and it more easily makes it possible for the constriction to be larger, in both the length direction and the transverse direction, than the height and diameter of the solid body. The reason is that, owing to the nearby wall of the pumping tube, the opening and the solid body cannot be rendered congruent in the best way possible.

When the constriction of the lumen is elliptical, at least one dimension (transverse dimension or length dimension) should be larger (by approximately 0.1 to 0.3 mm) than the height or diameter, respectively, of the solid body. The optimum range is when the ratio of the axis of the constriction is between 1.1 and 2.0, in which case the (shorter) transverse dimension should be greater than 1.0 mm, in order not to impair the diffusion.

In another embodiment, the circular opening of the pumping tube is retained. In this case, however, the effective cross-section is restricted in that a wire piece, or the like, spans the opening transversely and thus acts as a block.

Another possibility is the use of a glass foam plug which is introduced into the, in per se, circular cylindrical opening of the pumping tube. In a first embodiment, the foam has, at least in part, open pores in order to permit diffusion of mercury into the discharge vessel. In a second embodiment, the foam may have a high proportion of closed pores; in this case, the opening will not be completely closed off by the glass foam plug and a small opening for the diffusion of the mercury will remain. Finally, it is possible to use mixed forms of the two embodiments.

In a first particularly preferred embodiment, the solid body can act not only as a plug but also as a sponge for the Hg body. In this case, as is known per se, the solid body forms a porous matrix as its base, which contains liquid mercury or liquid amalgam in its cavities. In addition to this, an amalgam partner suitable for forming the amalgam can be incorporated in liquid or solid form behind the solid body.

In a second particularly preferred embodiment, it is also possible to use an amalgam which is solid at room temperature. In this case, the amalgam is only introduced into the pumping tube after the solid body has been introduced, so that the amalgam lies behind the solid body, relative to the pumping opening on the discharge side. In this case, the constitution of the solid body is of no importance but, however, its geometrical dimensioning is, as before, of importance.

The invention is explained below in more detail with the aid of several exemplary embodiments.

DRAWINGS

Figure 3A:
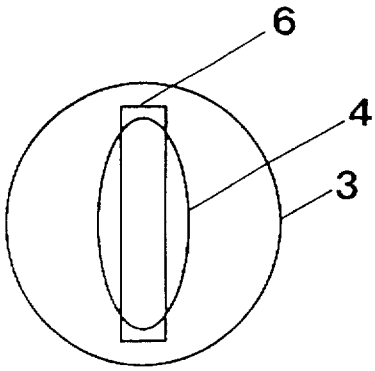
Figure 3B:
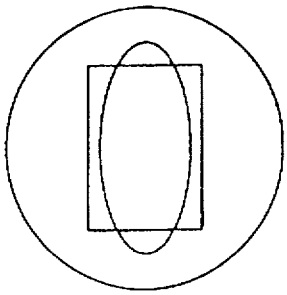
Figure 3C:
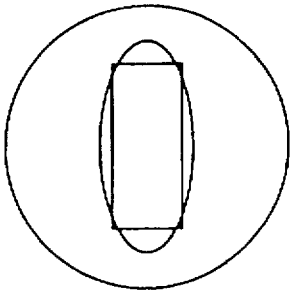
Figure 4:
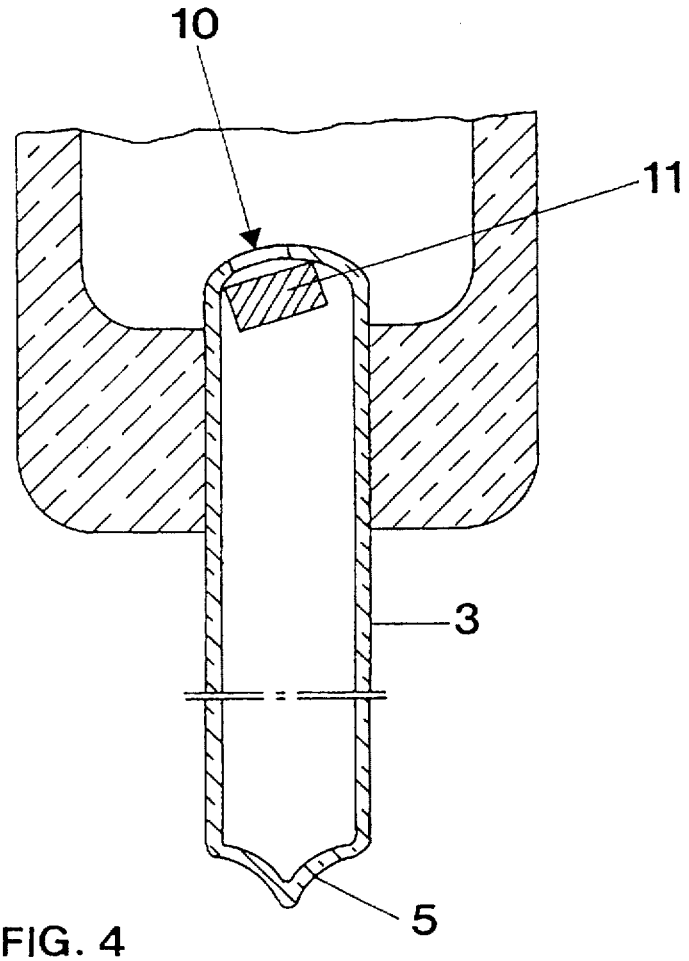
Figure 5:
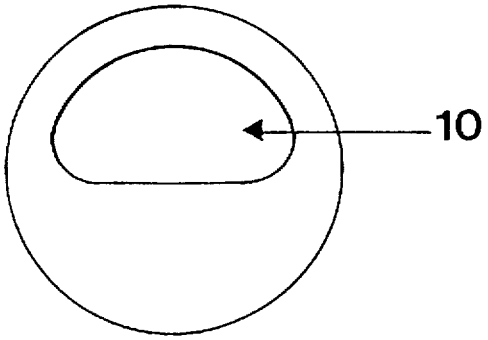
Figure 6:
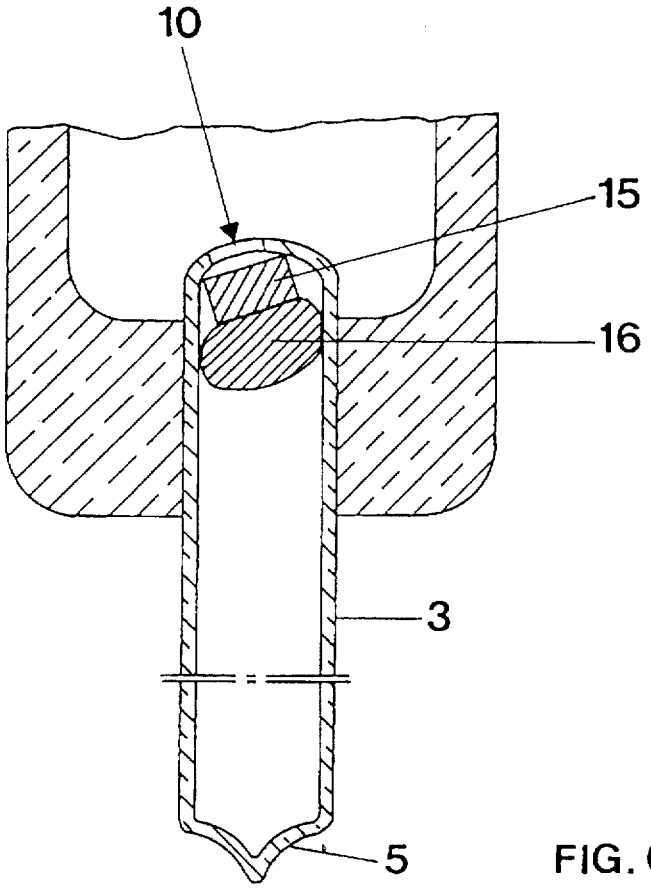
Figure 7A:
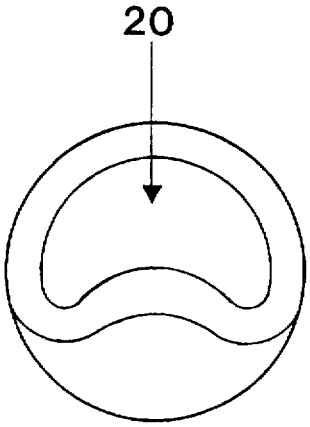
Figure 7B:
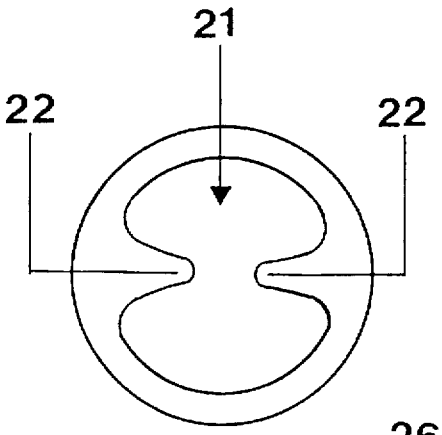
Figure 8:
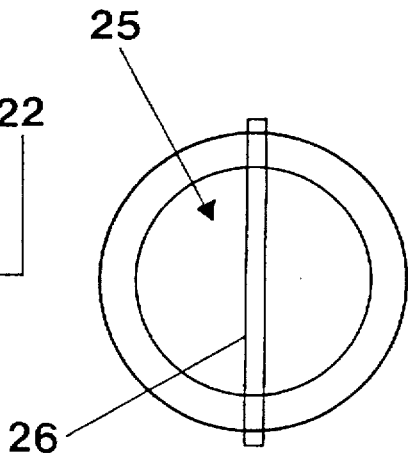
Figure 9A:
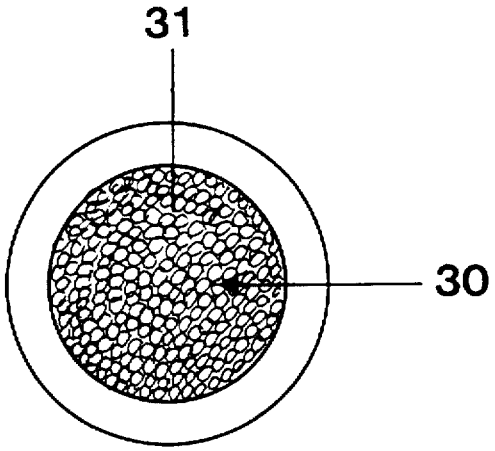

FIGS. 3 collectively show a plan view of the pumping opening, with schematized representation of the solid body wherein FIGS. 3*a*, 3*b* and 3*c* show different embodiments;

FIG. 4 shows an enlarged representation of the pinch seal, with the pumping stem, in a second embodiment;

FIG. 5 shows a plan view of the pumping opening of the second exemplary embodiment;

FIG. 6 shows an enlarged representation of the pinch seal, with the pumping stem, in a third embodiment;

FIG. 7*a* shows a further embodiment of the pumping opening;

FIG. 7*b* shows another embodiment of the pumping opening;

FIG. 8 shows another embodiment of the constricted pumping opening;

FIG. 9*a* shows a further embodiment of the pumping opening; and

Figure 9B:
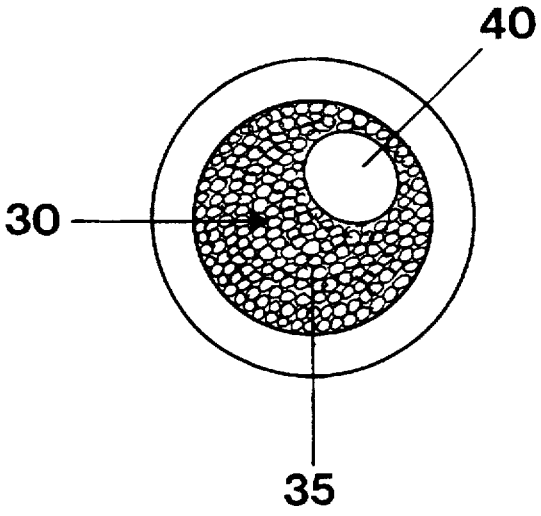

FIG. 9*b* shows another embodiment of the pumping opening.

DETAILED DESCRIPTION

Figure 1:
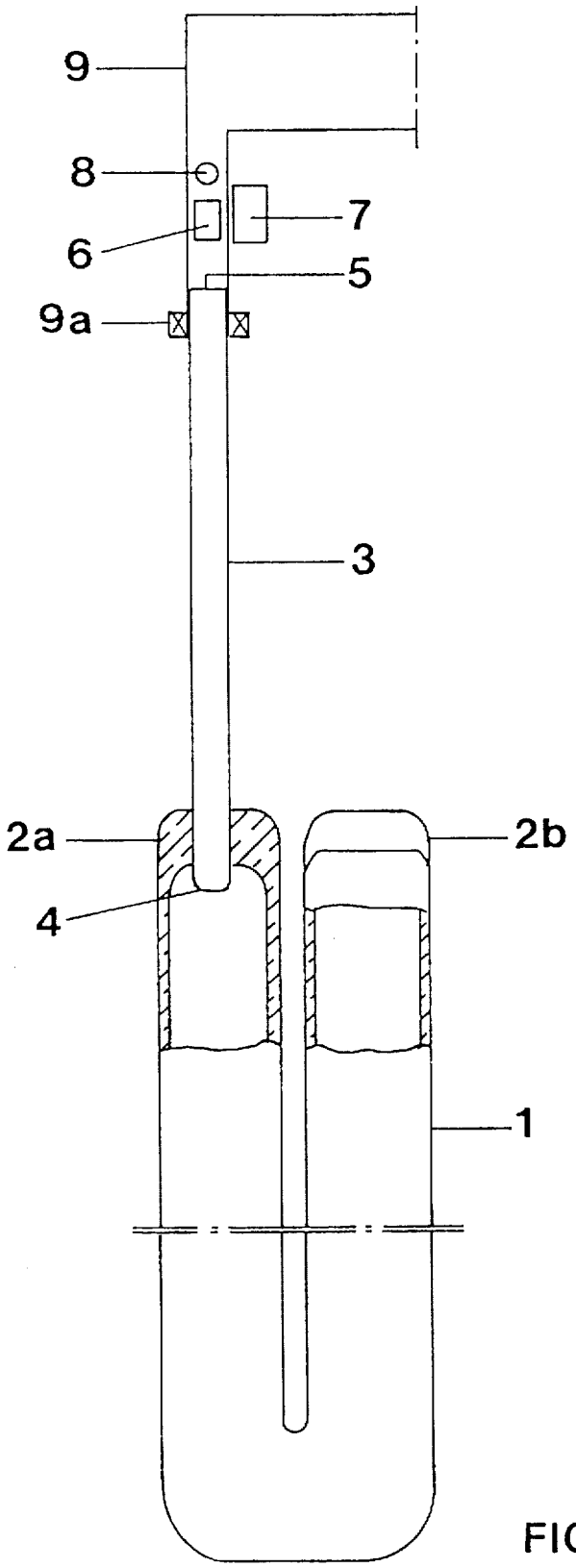
FIG. 1 shows a schematic representation of a discharge vessel.

FIG. 1 shows a discharge vessel 1, which is bent in the shape of a U, for a compact fluorescent lamp. Vessel 1 has two ends 2*a*, 2*b* into which electrodes (not shown) are pinched. One end 2*a* is equipped in the middle with a pumping tube 3, the constricted discharge-side end 4 of which protrudes into the discharge vessel 1, whereas the circular end 5 remote from the discharge is externally accessible. During evacuation and filling with the aid of a pumping head 9, and a seal 9*a*, both pumping ends 4, 5 are first still open. A solid body 6, made of iron, is held by a magnet 7 at the middle of the pumping head 9. Behind it, a liquid or solid amalgam (or liquid mercury) 8 is introduced into the pumping tube. After the discharge vessel has been filled with noble gas, the magnet 7 is removed, so that the solid body 6 and the amalgam 8 (or Hg) slide to the discharge-side end 4 of the pumping tube. The end of the pumping tube remote from the discharge is subsequently cut off and sealed by melting.

Figure 2:
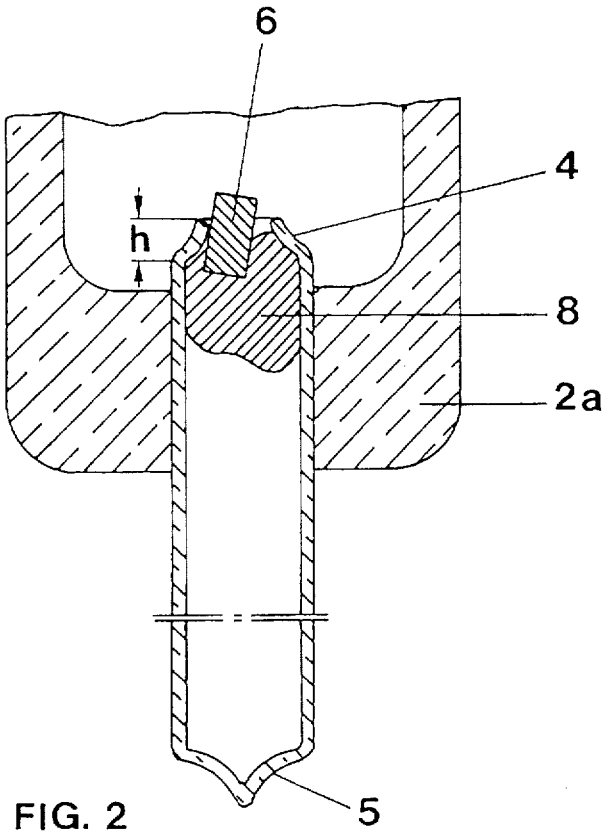
FIG. 2 shows an enlarged representation of the pinch seal with the pumping stem.

FIG. 2 shows an enlarged representation of the pinch region 2*a* and reversed by 180° with respect to FIG. 1. The pumping tube end 4 on the discharge side is constricted, so that the solid body 6 blocks the opening, in spite of the edgewise orientation, and stops the amalgam 8 from emerging into the discharge space. The pumping tube end 5 remote from the discharge is sealed by melting.

FIG. 3*a* shows that the solid body 6, shown lying transversely, and the pumping opening 4 are matched to each other. The pumping tube 3 has an internal diameter of approximately 2.5 mm and a wall thickness of 0.75 mm. The pumping opening 4 is elliptical and arranged centrally relative to the pumping tube 3. The longest length diameter is approximately 1.70 mm (corresponding, to twice the semi-major axis), the largest transverse dimension (corresponding to twice the semi-minor axis) is approximately 1.4 mm. The solid body is a circular cylinder of diameter 1.8 mm with a height of 1.2 mm. The structure of the opening extends over a height h of approximately 6 mm. Because of the different shape of the opening, the solid body cannot close off the opening, even in the transverse position. The diameter of the solid body 6 is suitably between 50% and 90%, and preferably between 60% and 80%, of the internal diameter of the pumping tube. The height of the solid body suitably is between 50% and 80% of its diameter.

As shown by FIGS. 3*b* and 3*c*, it is, however, also possible to choose other dimensions. FIG. 3*b* shows the opposite case to FIG. 3*a*, in which the length dimension of the opening 4 is larger than the diameter of the solid body 6. FIG. 3*c* shows the case which is theoretically most favorable (because of the unimpaired diffusion), the largest length dimension and in which the largest transverse dimension of the opening 4 are respectively larger than the diameter and thickness of the solid body 6. However, this opening is very difficult to produce. A plasma torch is advantageously used for this purpose.

The uniform pump openings of this kind are produced by using two mutually opposite gas burners, which are directed with different intensity onto the originally circular opening of the pumping tube. The molten glass contracts and forms a non-circular (here elliptical) opening.

In a second embodiment FIGS. 4 and 5), the pumping opening 10 is asymmetrical and arranged off-center. It is again partly blocked by the solid body 11 which is here a porous molded part in circular cylindrical form. It contains liquid mercury in its matrix. FIG. 5 shows that the pumping opening 10 has a half-moon shape. The internal diameter of the pumping tube is 2.5 mm. The largest length dimension of the opening is 2.5 mm, and the largest transverse dimension is 1.5 mm. The molded part has a diameter of 1.8 mm and a height of 1.2 mm.

Non-uniform pumping openings of this kind are produced by using a gas burner or plasma torch, which is directed at one side onto that region of the originally circular opening which is opposite to the subsequent opening of half-moon shape.

In a third exemplary embodiment (FIG. 6), a body 16 of solid amalgam or solid amalgam partner is again arranged behind the solid body 15. This body 15 consists, as known per se, of a bismuth/indium alloy in the ratio of approximately 2:1, or else a bismuth/lead/tin alloy. Further examples are Bi-Pb or Bi-Pb-In or Bi-Pb-Ag alloys. In addition, they respectively contain a few percent of mercury. With regard to the amalgams used, reference is made, for example, to U.S. Pat. No. 5,055,738, U.S. Pat. No. 4,972,118, DE-A 3510156, U.S. Pat. No. 4,636,686 and U.S. Pat. No. 4,093,889.

FIG. 7*a* schematically shows the plan view of a pumping opening 20 with crescent-like shape. A figure "8"-like shape of the pumping opening 21 is shown in FIG. 7*b*. The transverse bar 22 of the "8" is, in this case, not fully formed, for technical reasons.

FIG. 8 shows the plan view of a pumping opening 25 of circular shape, a wire piece 26 transversely constricting the opening 25.

FIG. 9*a* shows the plan view of a pumping opening 30 of circular shape, a glass foam plug 31 completely closing the opening 30. The foam has open pores, thus reducing the lumen of the tube. The thickness of the plug may be, for example, in the order of magnitude of about 2 to 10 mm.

FIG. 9*b* shows the plan view of a pumping opening 30 of circular shape, in which the lumen is reduced by a glass foam plug 35 which partly (75%) closes the opening 30. The opening 40 permits sufficient diffusion also in the event that the glass foam has mainly closed pores.

In order to manufacture such a glass foam plug, there is used, for example, water glass from which the water is suddenly removed by heating. The escaping water vapor causes the glass to foam, thereby forming pores.

We claim:

1. Low-pressure mercury-vapor discharge lamp having a discharge vessel (1);

a pumping tube (3) sealed into the discharge vessel, extending externally of, and internally into the discharge vessel, said pumping tube defining a lumen and having an inner end (4) which is open and located interiorily of said discharge vessel (1); and mercury (Hg), in metallic Hg form or as an amalgam, located within said pumping tube (3), wherein, in accordance with the invention, the lumen of the open inner end (4) is reduced, or constricted with respect to the lumen of the remainder of the pumping tube to form an end portion of reduced lumen at said open inner end; and wherein, in addition to said mercury or amalgam, a solid body (6, 11, 15) is located within the pumping tube (3), said solid body being dimensioned and shaped to partly close off the open inner end (4) of the pumping tube, and prevent escape of the solid body from the pumping tube, and hence escape of non-vaporized mercury from the end (4) of reduced, or constricted lumen of the pumping tube.

2. The lamp according to claim 1, characterized in that the solid body has, in every orientation, a different cross-section from the pumping opening.

3. The lamp according to claim 1, characterized in that the solid body forms at least approximately a circular cylinder with assigned diameter and assigned height.

4. The lamp according to claim 3, characterized in that the diameter of the solid body corresponds to between 50 and 90% of the internal diameter of the pumping tube.

5. The lamp according to claim 3, characterized in that the height of the solid body is less than the diameter of the solid body, the height corresponding to about 50–80% of the diameter of the solid body.

6. The lamp according to claim 3, characterized in that the opening of the pumping tube defines a largest length dimension and transverse dimension, the length dimension being larger than the transverse dimension, in particular by a factor of 1.1 to 2.0.

7. The lamp according to claim 6, characterized in that the largest transverse dimension is larger, and optionally larger by 0.1 mm to 0.4 mm, than the height of the solid body.

8. The lamp according to claim 6, characterized in that the largest length dimension is larger than the diameter of the solid body.

9. The lamp according to claim 6, characterized in that the largest transverse dimension is smaller than the diameter of the solid body.

10. The lamp according to claim 1, characterized in that the opening is ellipse, half-moon, crescent or "8" shaped.

11. The lamp according to claim 1, characterized in that the solid body is ferromagnetic.

12. The lamp according to claim 1, characterized in that the solid body comprises a base formed as a porous matrix.

13. The lamp according to claim 12, characterized in that the mercury or its amalgam is liquid is incorporated in the matrix.

14. The lamp according to claim 1, characterized in that the amalgam is solid at room temperature and, relative to the inner opening (4), is positioned behind the solid body.

15. The lamp according to claim 1, characterized in that the pumping tube (3) is located at one end (2*a*) of the discharge vessel.

16. The lamp according to claim 15, characterized in that said one end (2*a*) is closed off by means of a pinch or press seal.

17. The lamp according to claim 1, characterized by a wire element extending transversely of said open inner end (4) to reduce the lumen thereof.

18. The lamp according to claim 1, characterized by a glass foam plug (31; 35) with through-pores forming passages through the glass foam plug to reduce the lumen of said open inner end (4).

19. The lamp according to claim 1, characterized in that said solid body comprises a glass foam plug.

20. The lamp according to claim 1, characterized in that the position of the open inner end (4) of the pumping tube is off-center with respect to an axis of said pumping tube.

21. A method of making a fluorescent lamp, as claimed in claim 1, characterized by providing said pumping tube (3) having, at one end, said end portion with said open end (4) of reduced, or constricted lumen with respect to the lumen of the remainder of said tube;

sealing said pumping tube into an opening of the discharge vessel with said end portion with said open end of reduced, or constricted lumen within the vessel;

introducing said solid body, and optionally then a further body, into a pumping head;

coupling a pumping head to the pumping tube externally of the discharge vessel;

holding the solid body remote from the interior of the vessel and at least in the vicinity of, or in, the pumping head;

evacuating said discharge space by said pumping head through said pumping tube coupled to said pumping head;

introducing an inert gas at low pressure into the discharge vessel;

terminating said step of holding the solid body and introducing said solid body, and optionally said further body, adjacent said open end (4) of the pumping tube, and of reduced or constricted lumen; and closing off the pumping tube outside of the discharge vessel.

22. The method according to claim 21, wherein said solid body is ferromagnetic and said holding step comprises providing a magnet outside of the pumping tube to hold said solid ferromagnetic body in the vicinity of, or inside, the pumping head.

23. The method according to claim 21, wherein said introduction step comprises positioning said pumping tube to be in essentially vertical direction, and permitting said solid body and, optionally, said further body, to drop, by gravity, through said tube and up to about said reduced, or constricted opening (4), upon termination of said holding step.

* * * * *